US011051610B2

(12) United States Patent
Nguyen et al.

(10) Patent No.: US 11,051,610 B2
(45) **Date of Patent: *Jul. 6, 2021**

(54) LIGHTED TOOTHBRUSH WITH FRONT BASE BUTTON

(71) Applicant: Children Oral Care, LLC, La Palma, CA (US)

(72) Inventors: Huy Kha Nguyen, Anaheim, CA (US); Geoff Carroll, Los Angeles, CA (US); Aaron Onglingswan, Costa Mesa, CA (US)

(73) Assignee: Ranir, LLC, Grand Rapids, MI (US)

( * ) Notice: Subject to any disclaimer, the term of this patent is extended or adjusted under 35 U.S.C. 154(b) by 21 days.

This patent is subject to a terminal disclaimer.

(21) Appl. No.: 16/376,011

(22) Filed: Apr. 5, 2019

(65) Prior Publication Data

US 2019/0246784 A1 Aug. 15, 2019

Related U.S. Application Data

(63) Continuation of application No. 15/085,848, filed on Mar. 30, 2016, now Pat. No. 10,251,473.

(60) Provisional application No. 62/140,647, filed on Mar. 31, 2015.

(51) Int. Cl.
*A46B 15/00* (2006.01)
*A46B 9/04* (2006.01)

(52) U.S. Cl.
CPC ..... *A46B 15/0044* (2013.01); *A46B 9/04* (2013.01); *A46B 15/0008* (2013.01); *A46B 15/0097* (2013.01); *A46B 2200/1066* (2013.01)

(58) Field of Classification Search
CPC ..... A46B 15/0008; A46B 15/0036; A46B 15/0044
See application file for complete search history.

(56) References Cited

U.S. PATENT DOCUMENTS

| | | | |
|---|---|---|---|
| 5,894,453 | A | 4/1999 | Pond |
| 6,606,755 | B1 | 8/2003 | Robinson et al. |
| 2006/0037158 | A1 | 2/2006 | Foley |
| 2007/0131241 | A1 | 6/2007 | Nanda |

(Continued)

FOREIGN PATENT DOCUMENTS

| | | |
|---|---|---|
| FR | 2680086 | 2/1993 |
| JP | 201275755 | 4/2012 |

(Continued)

OTHER PUBLICATIONS

European Patent Application No. 16774126.3—Extended European Search Report dated Oct. 11, 2018.

(Continued)

*Primary Examiner* — Mark Spisich
(74) *Attorney, Agent, or Firm* — Warner Norcross + Judd LLP

(57) ABSTRACT

A toothbrush including a handle extending in a longitudinal direction and including an upper portion and a base. The upper portion includes an insert portion. The base is made of a flexible material and overlaps the insert portion and includes an interior cavity. A light is configured to emit light visible from outside the handle. An activation device is positioned in the interior cavity and is configured to be pressed in a direction transverse to the longitudinal direction to activate the light upon a user pressing the base.

15 Claims, 9 Drawing Sheets

(56) References Cited

U.S. PATENT DOCUMENTS

| | | | | |
|---|---|---|---|---|
| 2008/0196184 | A1 | 8/2008 | Dooley | |
| 2009/0144920 | A1 | 6/2009 | Nanda | |
| 2010/0050357 | A1 | 3/2010 | Misner et al. | |
| 2011/0232012 | A1* | 9/2011 | Nanda | A46B 15/0008 15/22.1 |
| 2012/0137454 | A1* | 6/2012 | Huy | A46B 15/0044 15/22.1 |
| 2014/0123420 | A1 | 5/2014 | Nanda | |
| 2015/0013088 | A1* | 1/2015 | Li | A46B 15/0087 15/167.1 |
| 2015/0335145 | A1* | 11/2015 | Bloch | A46B 15/0008 15/22.1 |

FOREIGN PATENT DOCUMENTS

| | | | |
|---|---|---|---|
| JP | 201464760 | | 4/2014 |
| WO | 9963859 | | 12/1999 |
| WO | 20140989949 | A1 | 6/2014 |

OTHER PUBLICATIONS

Chinese Patent Application No. 2016800314487—First Office Action dated Apr. 3, 2019.

* cited by examiner

LIGHTED TOOTHBRUSH WITH FRONT BASE BUTTON

CROSS REFERENCE TO RELATED APPLICATIONS

This application claims the benefit of U.S. Provisional Application No. 62/140,647 filed Mar. 31, 2015, the entire contents of which are incorporated herein by reference. This application is a continuation of application Ser. No. 15/085,848 filed. Mar. 30, 2016, now U.S. Pat. No. 10,251,473.

BACKGROUND

Children notoriously have a short attention span when they attempt to brush their teeth. It may be difficult to entice a child to brush his or her teeth, and even more difficult to encourage a child to brush for the recommended duration of time. In addition, complicated electrical devices that may be designed to encourage children to brush are often fragile, and may break easily when used by a child. Such complicated electrical devices may also be difficult for a child to easily activate.

SUMMARY

The embodiments of toothbrushes disclosed herein are designed to address the aforementioned problems in the art. The embodiments of toothbrushes are designed to enhance durability of devices for encouraging children to brush, as well as enhancing the ease in which such devices are activated by children.

In embodiments disclosed herein, a toothbrush includes a head including a plurality of bristles. A handle extends in a longitudinal direction and includes an upper portion and a base. The upper portion includes an insert portion. The base is made of a flexible material and overlaps the insert portion and includes an interior cavity. A light is configured to emit light visible from outside the handle. A power source is positioned in the interior cavity and is configured to supply power to the light. An activation device is positioned in the interior cavity and is configured to be pressed in a direction transverse to the longitudinal direction and towards the power source to activate the light upon a user pressing on the base.

A toothbrush includes a head including a plurality of bristles. A handle is coupled to the head and extends in a longitudinal direction and includes an interior cavity, an upper portion, and a base having an interior surface, at least a portion of the base defining a push point. A light is positioned in the interior cavity and is configured to emit light visible from outside the handle. A dome is positioned in the interior cavity and is configured such that the interior surface of the base contacts the dome to complete a circuit to cause the light to be activated upon a user pressing the push point in a direction transverse to the longitudinal direction.

A toothbrush includes a head including a plurality of bristles. A handle is coupled to the head and extends in a longitudinal direction and includes an interior cavity. At least a portion of the handle is flexible. A light is configured to emit light visible from outside the handle. A power source is configured to supply power to the light. An electrical terminal is electrically coupled to the light. An electrically conductive lever has a first end and a second end configured to rotate about the first end, the lever being configured such that the second end contacts the electrical terminal to complete a circuit to cause the light to be activated upon a user pressing the portion of the handle in a direction transverse to the longitudinal direction.

A toothbrush includes a head including a plurality of bristles. A handle is coupled to the head and includes a sidewall surrounding an interior cavity of the handle. At least a portion of the sidewall defines a push point. A light is configured to emit light visible from outside the handle. A power source is configured to supply power to the light. An activation device is positioned in the interior cavity behind the push point and is configured to be moved to activate the light upon a user pushing on the push point.

BRIEF DESCRIPTION OF THE DRAWINGS

Features and advantages of the systems, apparatuses, and methods as disclosed herein will become appreciated as the same become better understood with reference to the specification, claims, and appended drawings wherein:

DETAILED DESCRIPTION

Figure 1:
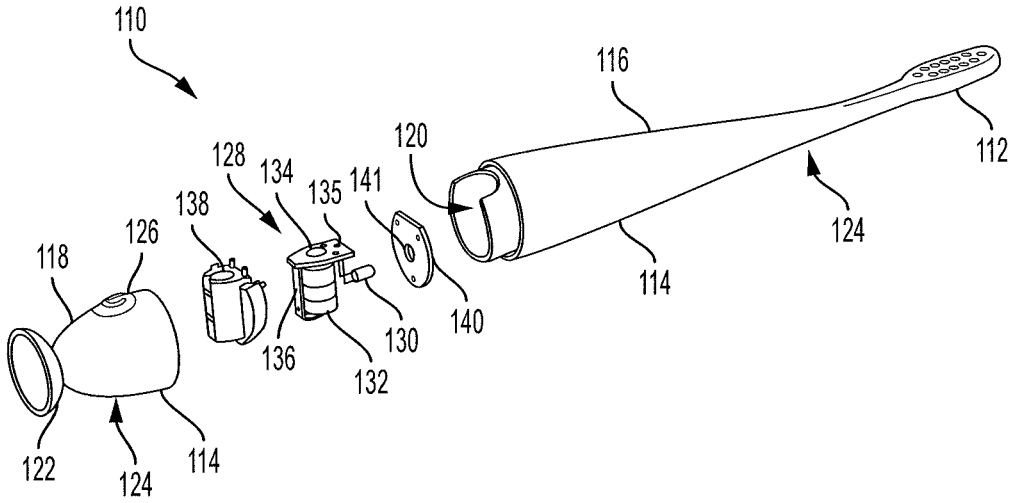
FIG. 1 illustrates a side perspective view of a toothbrush in a disassembled state, according to an embodiment of the present disclosure.

FIG. 1 illustrates a side perspective view of a toothbrush 110 of the present disclosure, in a disassembled state. The toothbrush 110 may include a head 112 and a handle 114.

The toothbrush 110 may extend in a longitudinal direction. The handle 114 may include an upper portion 116 and a base 118.

Figure 2:
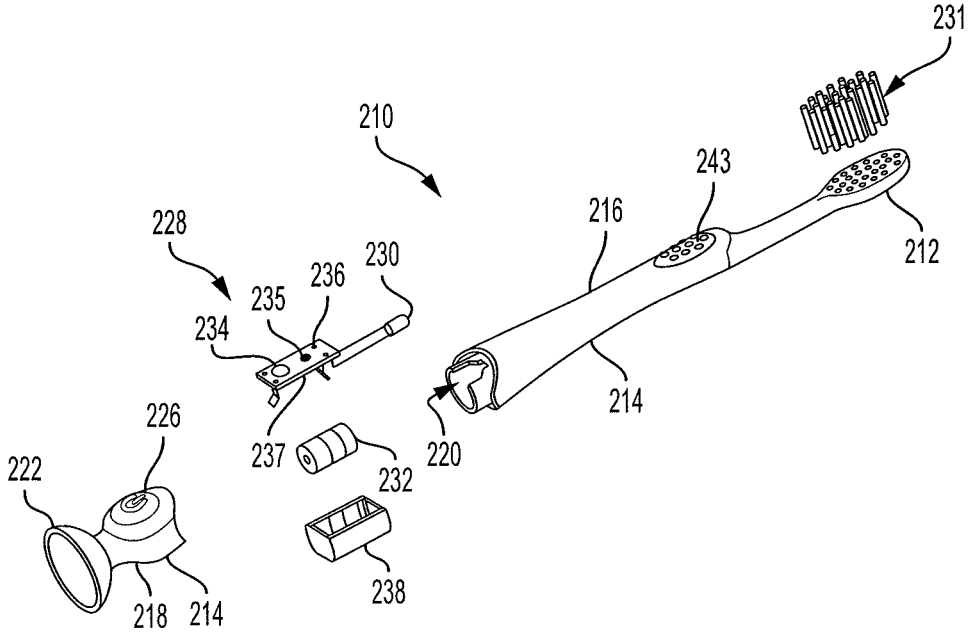
FIG. 2 illustrates a side perspective view of a toothbrush in a disassembled state, according to an embodiment of the present disclosure.

The head 112 may be configured to include a plurality of bristles for brushing a user's teeth, such as the bristles 231 shown in FIG. 2. An end of the handle 114 that is proximal the head 112 may couple to the head 112. The base 118 may be positioned at an end of the handle 114 that is distal the head 112.

The upper portion 116 of the handle 114 may be configured for a user to grasp when using the toothbrush 110. The upper portion 116 may taper down in size from a distal end to an end that is proximal the head 112. The upper portion 116 of the handle 114 may include an interior cavity 120 configured to retain electronics or other structures for use with the toothbrush 110. The interior cavity 120 may extend over the entirety of the interior of the handle 114 or over only a portion of the interior of the handle 114. At least a portion of the upper portion 116 may be made of a material that is visible light transmissive, to allow light emitted from the interior of the toothbrush 110 to be visible from outside of the toothbrush 110. In one embodiment, the entirety of the upper portion 116 may be visible light transmissive.

The base 118 may form the distal end of the toothbrush 110. The base 118 may be configured to couple to a distal end of the upper portion 116. The base 118 may include an interior cavity, which may be contiguous with the interior cavity 120 of the upper portion 116. The base 118 may include a suction cup 122 for suction to a surface, to fix the toothbrush 110 in position. The suction cup 122 may be positioned at the bottom of the toothbrush 110. The base 118 may have an inverted dome shape, as shown in FIG. 1.

In one embodiment, the base 118 may be made of a flexible material, which may be more flexible than the material that the upper portion 116, or another portion of the handle 114, is made out of.

The upper portion 116 and base 118 may define a sidewall 124 that extends along the side of the toothbrush 110. The sidewall 124 may extend along the base 118 and upper portion 116 to the head 112. The sidewall 124 may surround the interior cavity 120 of the handle 114.

At least a portion of the handle 114 may define a push point 126. The push point 126 may be an area or zone configured for a user to push. The area or zone configured for a user to push may be positioned adjacent the bottom of the toothbrush 110. In the embodiment shown in FIG. 1, the sidewall 124 along the base 118 defines the push point 126. In other embodiments, the sidewall 124 along the upper portion 116 may define the push point 126. In the embodiment shown in FIG. 1, the push point 126 is configured as a contoured portion of the base 118, which may be raised above adjacent portions of the base 118. The push point 126 may be configured to be depressible. The push point 126 may be configured to be made of a flexible material. The push point 126 may be pressed in a direction transverse to the longitudinal direction the toothbrush 110 extends along. At least a portion, or all, of the handle 114 may be made of a flexible material.

A lighting mechanism 128 may be positioned in the interior cavity 120. The lighting mechanism 128 may include a light 130, a power source 132, an activation device 134, and a control circuit 135. The light 130, power source 132, activation device 134, and control circuit 135 may be coupled to a connecting structure 136. The connecting structure 136 may be positioned in a housing 138 that is retained in the interior cavity 120. A retaining plate 140 may be positioned in the interior cavity 120 and couple to the housing 138. The connecting structure 136 may be sandwiched between the retaining plate 140 and the housing 138.

The light 130 may be configured as a device for producing light, such as an incandescent bulb, a light emitting diode (LED), or other forms of lights. The light 130 may be positioned in the interior cavity 120 such that the light emitted from the light 130 may pass through the handle 114 and be visible from outside of the toothbrush 110.

The power source 132 may be configured to supply power to the light 130. The power source 132 may be electrically connected to the light 130. The power source 132 may be configured as a battery or plurality of batteries, including for example three batteries. In one embodiment, the power source 132 may be configured as a renewable energy source, or a capacitor, or another form of power source.

The activation device 134 may be configured to activate the light 130. The activation device 134 may be configured to be moved to activate the light 130. The activation device 134 may be configured to be contacted by a portion of the sidewall 124 defining a push point 126 to activate the light 130. The activation device 134 may be configured as a switch, in which two electrical terminals are connected to complete an electric circuit. In one embodiment, the activation device 134 may be configured as a dome, as shown in FIG. 1. In one embodiment, the activation device 134 may be configured as a tab or extension that extends outward. The activation device 134 may be configured to extend in a direction towards the interior surface of the sidewall of the toothbrush 110. The activation device 134 may be positioned in the interior cavity 120 behind the push point 126 and configured to be moved to activate the light 130 upon a user pushing on the push point 126. The activation device 134 may be positioned between the portion of the sidewall 124 defining the push point 126 and the power source 132.

The connecting structure 136 may include structural elements to connect the light 130, power source 132, and activation device 134. The connecting structure 136 may also include electrical elements to connect the light 130, power source 132, and the activation device 134. The connecting structure 136 may be configured such that the light 130, power source 132, and the activation device 134 are coupled together as a unit for insertion into the interior cavity 120 as a unit. For example, the unit may be inserted into the interior cavity 120, and the base 118 may then be coupled to the upper portion 116 to enclose the unit within the toothbrush 110 during assembly.

The housing 138 may be configured as a shell housing, that is shaped to form fit the connecting structure 136, and the components connected thereto. The housing 138 may be configured to connect to an interior surface of the handle 114 to retain the housing 138 in position within the handle 114.

The retaining plate 140 may include an aperture 141 for the light 130 to extend through, such that the retaining plate 140 is positioned between the light 130 and the power source 132. The retaining plate 140 may serve to block a view of the internal workings of the lighting mechanism 128 from a user.

The lighting mechanism 128 may be oriented within the handle 114 such that a user pushing on the push point 126 activates the lighting mechanism 128. The activation device 134 may be positioned adjacent the push point 126. A user pushing on the push point 126 may press the interior of the handle 114, including the interior surface of the handle 114, against the adjacent activation device 134 to activate the lighting mechanism 128. The activation device 134 may be configured to move in a direction away from the sidewall, and towards the power source 132. The connecting structure 136 may be configured to position the activation device 134 adjacent the push point 126. The interior surface of the base 118 positioned opposite the push point 126 is configured to contact the activation device 134 to press the activation device 134 to activate the light 130.

The light 130 may illuminate upon activation of the lighting mechanism 128. The light 130 may be configured to steadily remain on or may be configured to flash. The control circuit 135 may be configured to control operation of the light 130. The control circuit 135 may be configured to automatically turn off the light 130 after a predetermined period of time. The control circuit 135 may be configured to cause the light 130 to flash for a predetermined period of time, and then automatically turn off. In one embodiment, the predetermined period of time may be between 120 and 180 seconds. In one embodiment, the predetermined period of time may be greater than 180 seconds. In one embodiment, the predetermined period of time may be greater than 15 seconds and less than or equal to 120 seconds, or 180 seconds. In one embodiment, the predetermined period of time may be 60 seconds. In one embodiment, the predetermined period of time may be a different duration, as desired.

In one embodiment, the control circuit 135 may be configured to illuminate the light 130, for example flashing, until a user presses the activation device 134 again. In one embodiment, the control circuit 135 may be configured to pause illumination, including flashing, of the light 130 upon a user pressing the activation device 134 if a portion of the predetermined period of time has not yet elapsed. If the user presses the activation device 134 again, the remaining predetermined period of time will elapse and then the illumination of the light 130 will cease. For example, if the predetermined period of time is 180 seconds, the user may press the activation device 134 to start a timer of the 180 seconds. If a user presses the activation device 134 again without the 180 seconds expiring, then the light will stop illumination. If the user again presses the activation device 134, the light 130 will start illumination for the remainder of the 180 seconds and may then automatically turn off upon expiration of the 180 seconds.

The light 130 may encourage children to brush by indicating a duration that the child is supposed to brush for.

The connecting structure 136 may be configured to orient the power source 132 radially with respect to the axial direction of the handle 114. The power source 132 may be positioned adjacent the activation device 134 and extend in a radial direction from the activation device 134. The push point 126, the activation device 134, and the power source 132 may each be positioned in-line. The light 130 may extend along the axial direction of the handle 114 away from the power source 132 and towards the head 112.

FIG. 2 illustrates a side perspective view of a toothbrush 210 of the present disclosure, in a disassembled state. Elements having the same last two reference numbers in this application are like elements, and the description of such like elements applies to all like elements unless otherwise specified.

In the embodiment shown in FIG. 2, the power source 232 is oriented to extend along the axial direction of the handle 214. The housing 238 may be shaped to form fit the power source 232 and may extend along the axial direction of the handle 214. The connecting structure 236 may include a circuit board 237 extending along the axial direction of the handle 214. The control circuit 235 may be positioned on the circuit board 237. The activation device 234 may be positioned on the circuit board 237. The activation device 234 may be in the form of a dome that is configured to be activated upon being pressed. The circuit board 237 may be positioned between the activation device 234 and the power source 232. The activation device 234 may be pressed in a direction towards the circuit board 237 and the power source 232 to complete the circuit.

The upper portion 216 of the handle 214 may include a thumb grip 243 for a user to rest their thumb upon when using the toothbrush 210.

Figure 3:
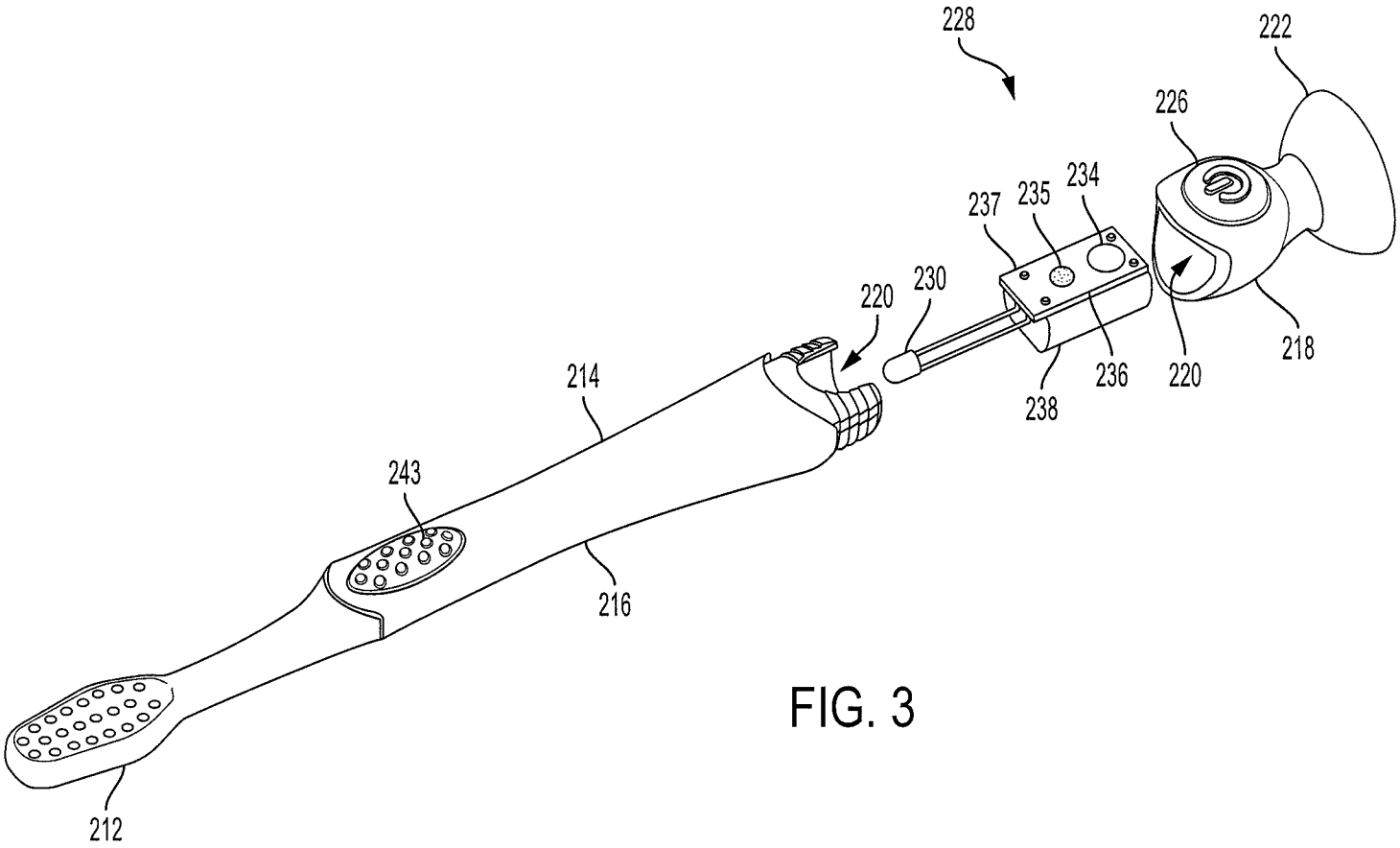
FIG. 3 illustrates a side perspective view of the toothbrush of FIG. 2 in a disassembled state, according to an embodiment of the present disclosure.

FIG. 3 illustrates a side perspective view of toothbrush 210, in a disassembled state. The housing 238 is coupled to the connecting structure 236. The housing 238 extends over and covers the power source 232. A portion of the connecting structure 236 in the form of electrical contacts extends through an upper portion of the housing 238 and connects with the light 230. A portion of the housing 238 abuts the circuit board 237. The housing 238, in combination with the light 230, power source 232, and the activation device 234 may be coupled together as a unit for insertion into the interior cavity 220 as a unit. The unit may have a substantially cylindrical shape as shown in FIG. 3.

Figure 4:
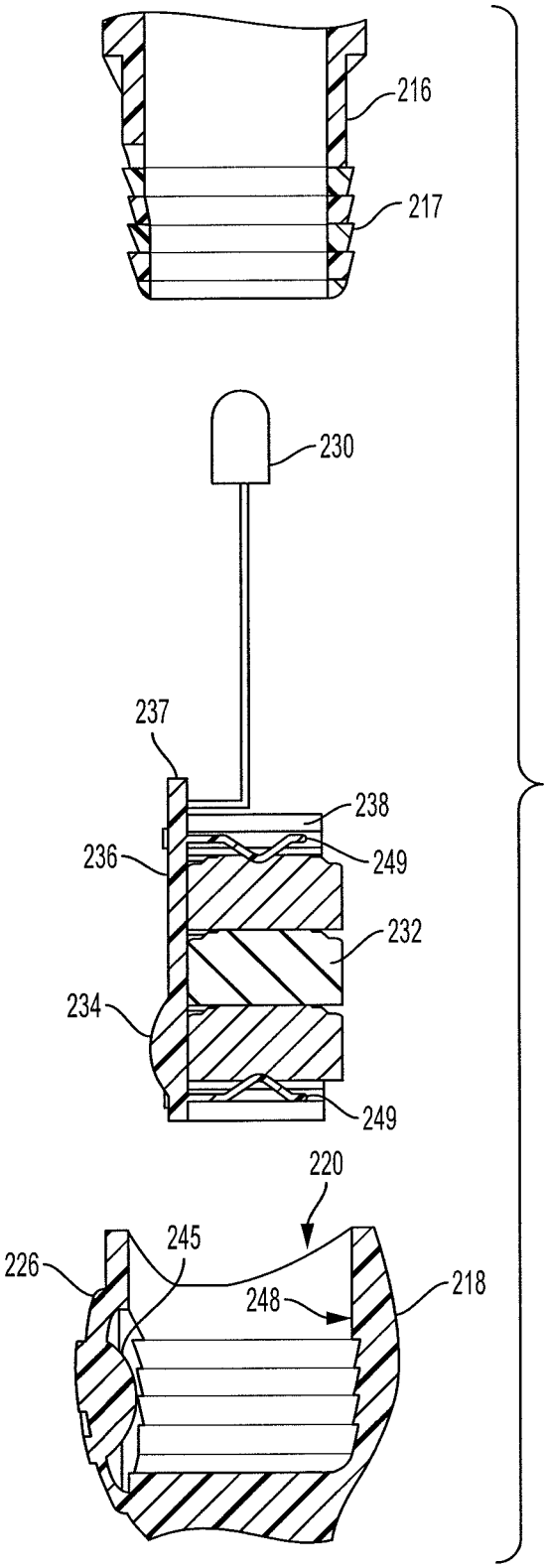
FIG. 4 illustrates a side cross section view of the toothbrush of FIG. 2.

FIG. 4 illustrates a side cross section view of the toothbrush of FIG. 3. The upper portion 216 of the handle may include ribbing 217 for the base 218 to be molded over to secure the base 218 to the upper portion 216. The circuit board 237 extends along the side of the power source 232. The connecting structure 236 may include electrical contacts 249 that extend laterally outward from the circuit board 237. The electrical contacts 249 are positioned between the power source 232 and the respective ends of the housing 238, and may be configured to transfer power from the power source 232.

The interior surface 248 of the base 218 that is positioned opposite the push point 226 may include a protrusion 245 configured to contact the activation device 234. The protrusion 245 may extend convex towards the activation device 234, and the activation device 234 may extend convex towards the protrusion 245.

Figure 6:
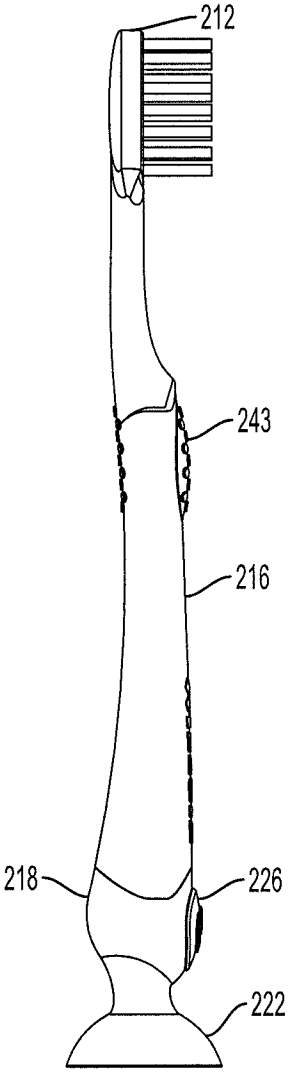
FIG. 6 illustrates a side view of the toothbrush of FIG. 2.
Figure 5:
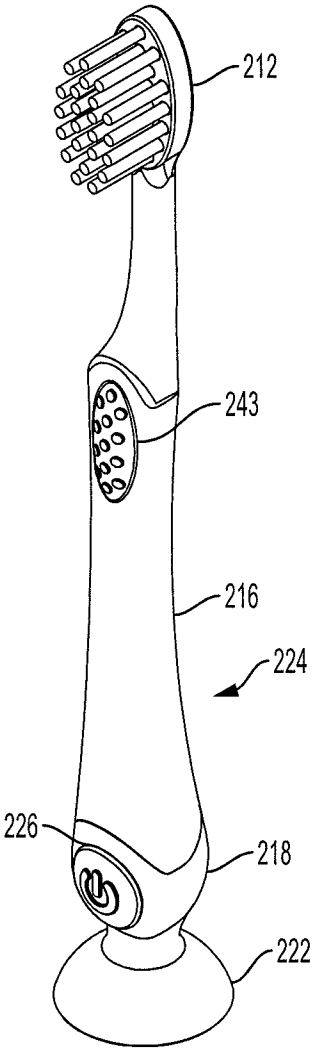
FIG. 5 illustrates a front perspective view of the toothbrush of FIG. 2.

FIG. 5 illustrates a front perspective view of toothbrush 210, including sidewall 224. FIG. 6 illustrates a side view of the toothbrush 210. The push point 226 forms a raised portion of the base 218. The thumb grip 243 forms a raised portion of the upper portion 216.

Figure 7:
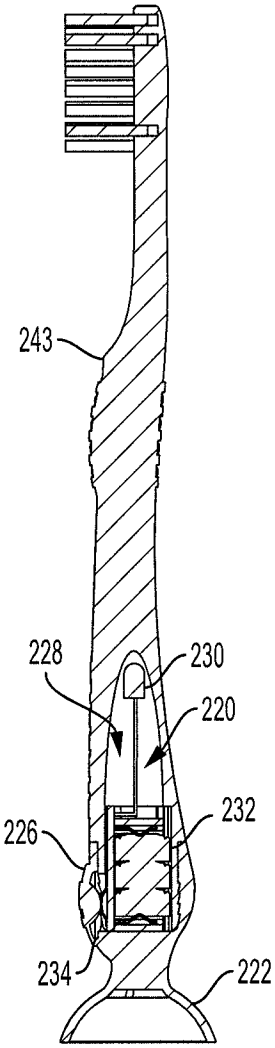
FIG. 7 illustrates a side cross section view of the toothbrush of FIG. 2.

FIG. 7 illustrates a cross sectional view of the toothbrush 210. The lighting mechanism 228 is positioned in the interior cavity 220. The activation device 234 is positioned such that the interior surface of the base 218 contacts the activation device 234 and presses the activation device 234 in a direction transverse to the longitudinal direction of the handle 214 to activate the light 230.

Figure 8:
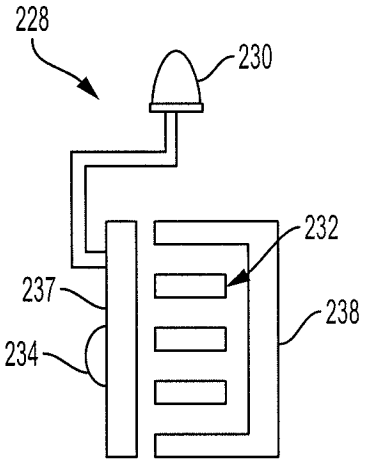
FIG. 8 illustrates a schematic representation of a lighting mechanism, according to an embodiment of the present disclosure.

FIG. 8 is a schematic representation of the lighting mechanism 228. The lighting mechanism 228 may be configured to be inserted into the interior cavity 220 as a unit. The pressing of the activation device 234 causes the light 230 to activate.

Figure 9:
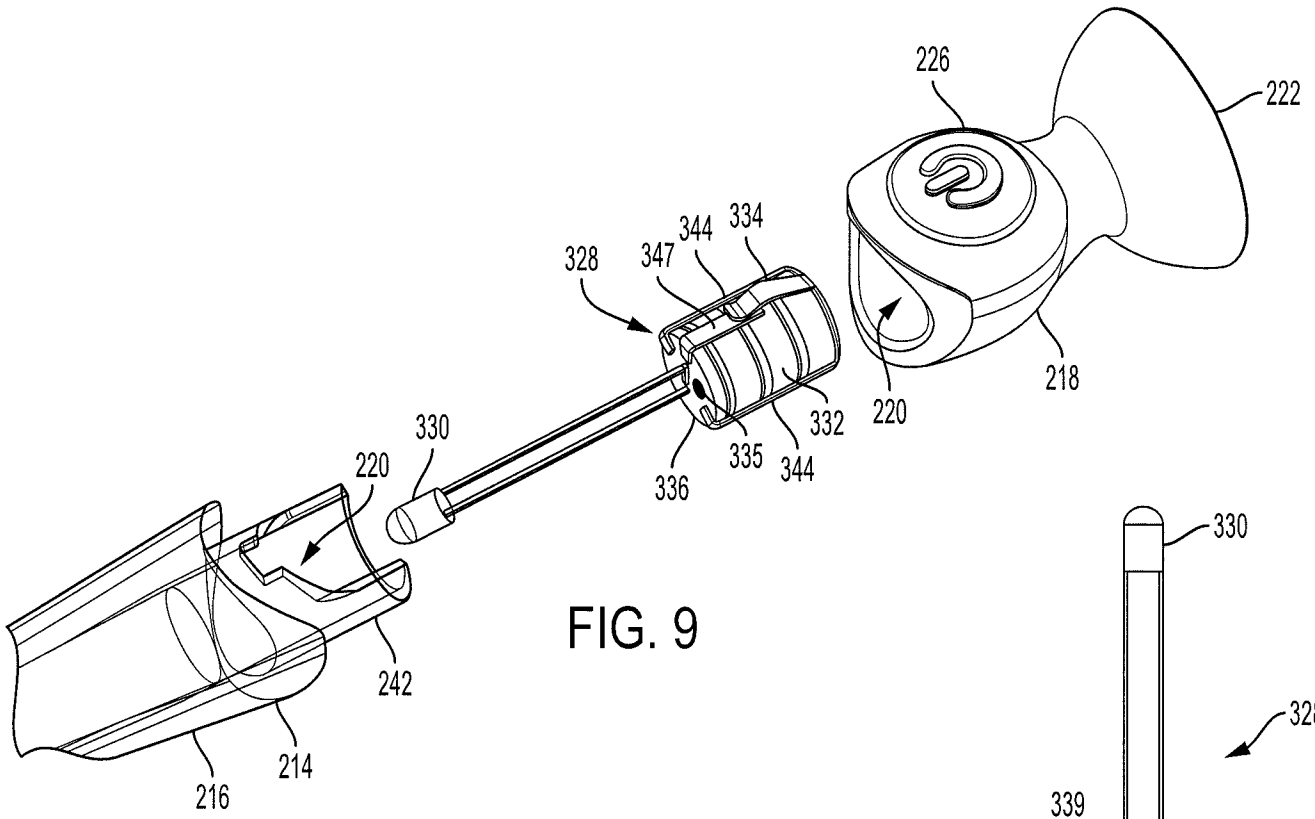
FIG. 9 illustrates a side perspective view of a toothbrush in a disassembled state, according to an embodiment of the present disclosure.

FIG. 9 illustrates a side perspective view of the toothbrush 210 including lighting mechanism 328. The lighting mechanism 328 may include an activation device 334 in the form of a lever having a first end coupled to the connecting structure 336 and a second end extending away from the first end at an angle. The lever may be electrically conductive and the second end may be configured to rotate about the first end towards the power source 332 to complete a circuit for illuminating the light 330. The second end may be configured to extend in a direction towards the sidewall of the toothbrush 210. The second end may be angled away from the first end in a direction towards the sidewall of the toothbrush 210. The connecting structure 336 may include plates 333, 339 that sandwich the power source 332. An electrical terminal 347 may extend from one of the plates 339 and extend in a direction towards the first end of the lever. The electrical terminal 347 may be electrically coupled to the light 330. An interior surface of the handle 214 may contact the lever to cause the second end to contact the electrical terminal 347. In operation, the user may push the push point 226, to move the lever such that the second end of the lever contacts the electrical terminal 347. The connection between the lever and the electrical terminal 347 may complete a circuit, to activate the light 330. The light 330 may be controlled by the control circuit 335. The user may push the push point 226 along the side of the toothbrush 210. The lever may be pressed in a direction transverse to the longitudinal direction the toothbrush 210 extends along.

The upper portion 216 of the handle 214 may include an insert portion 242 in the form of a sleeve that inserts into the interior cavity 220 of the base 218. The insert portion 242 may couple to the base 218 through use of an adhesive, or through a molding process, or other manner of coupling. The base 218 may be molded over the insert portion 242. The base 218 may couple to the upper portion 216 of the handle 214 such that a water tight seal of the interior of the toothbrush 210, including the interior cavity 220 is formed.

Figure 10:
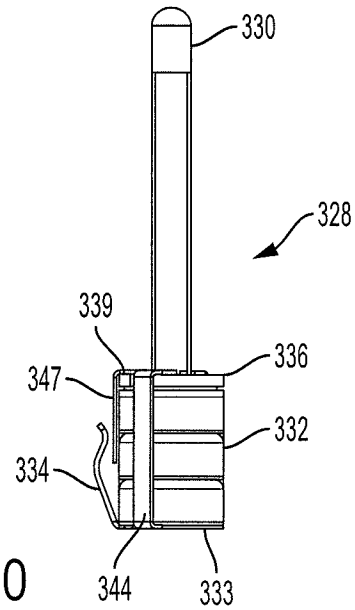
FIG. 10 illustrates a side view of a lighting mechanism, according to an embodiment of the present disclosure.

FIG. 10 illustrates a side view of the lighting mechanism 328. The connecting structure 336 may include connectors 344 that join the plates 333, 339 together, and extend over the sides of the power source 332. The lever may be biased to the position shown in FIG. 10 and may be deflected to contact the terminal upon a force being applied to the lever. The lever may be resilient and may return back to the position shown in FIG. 10 upon the force being withdrawn.

Figure 11:
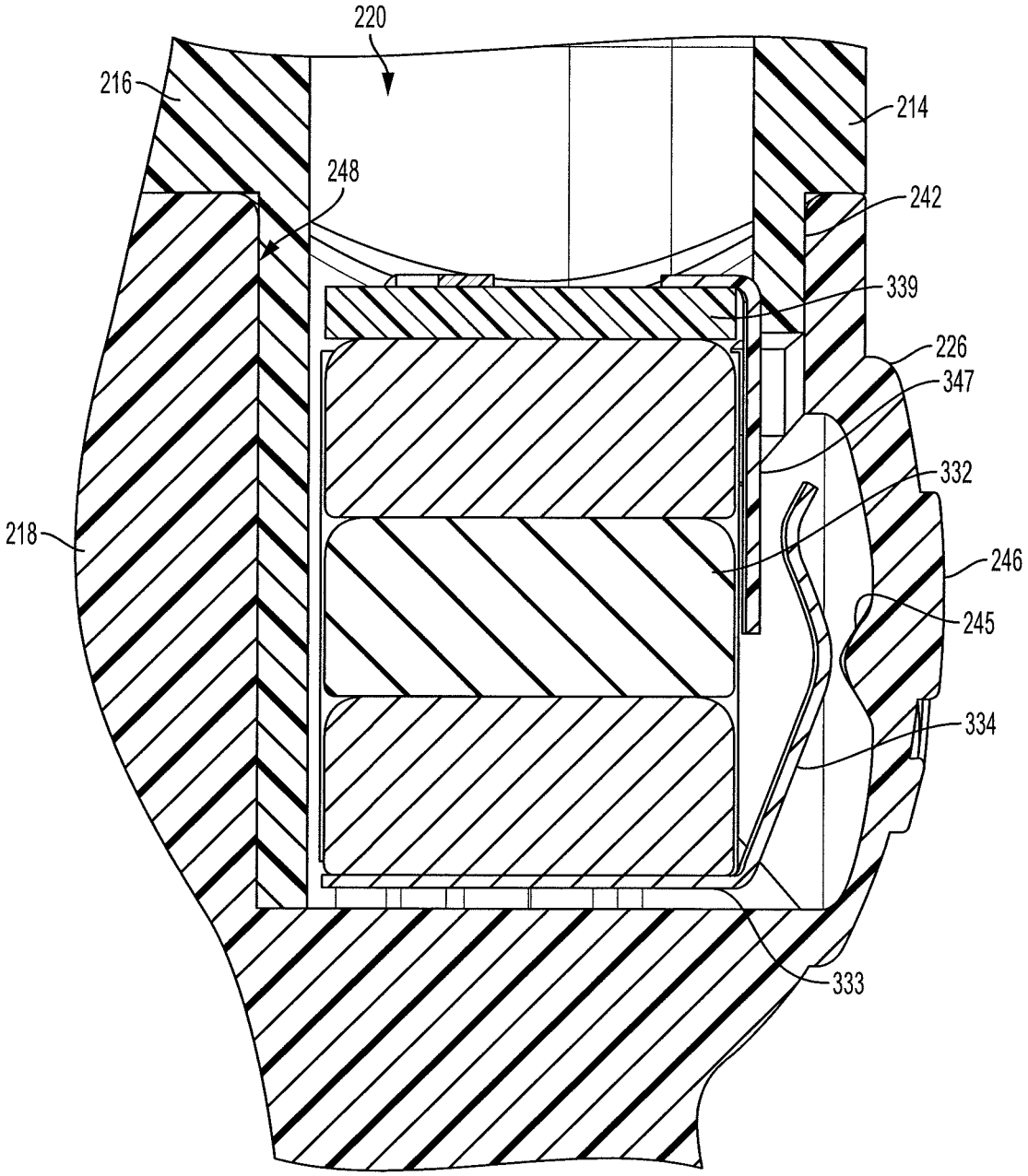
FIG. 11 illustrates a side cross section view of the lighting mechanism shown in FIG. 10 in position within the cavity of the toothbrush shown in FIG. 9.

FIG. 11 illustrates a side cross sectional view of the lighting mechanism 328 in position within the interior cavity 220 of the handle 214. The insert portion 242 extends into the base 218 and contacts the interior surface 248 of the base 218. The base 218 extends over the exterior surface of the insert portion 242. A portion of the insert portion 242 is cut away to allow the interior surface 248 of the base 218 to contact the activation device 334. A user may press the exterior surface 246 of the base 218 at the push point 226, to cause the interior surface 248 of the base 218 to contact the activation device 334 and activate the light 230. The interior surface 248 of the base 218 that is positioned opposite the push point 226 may include a protrusion 245 configured to contact the activation device 334.

Figure 12:
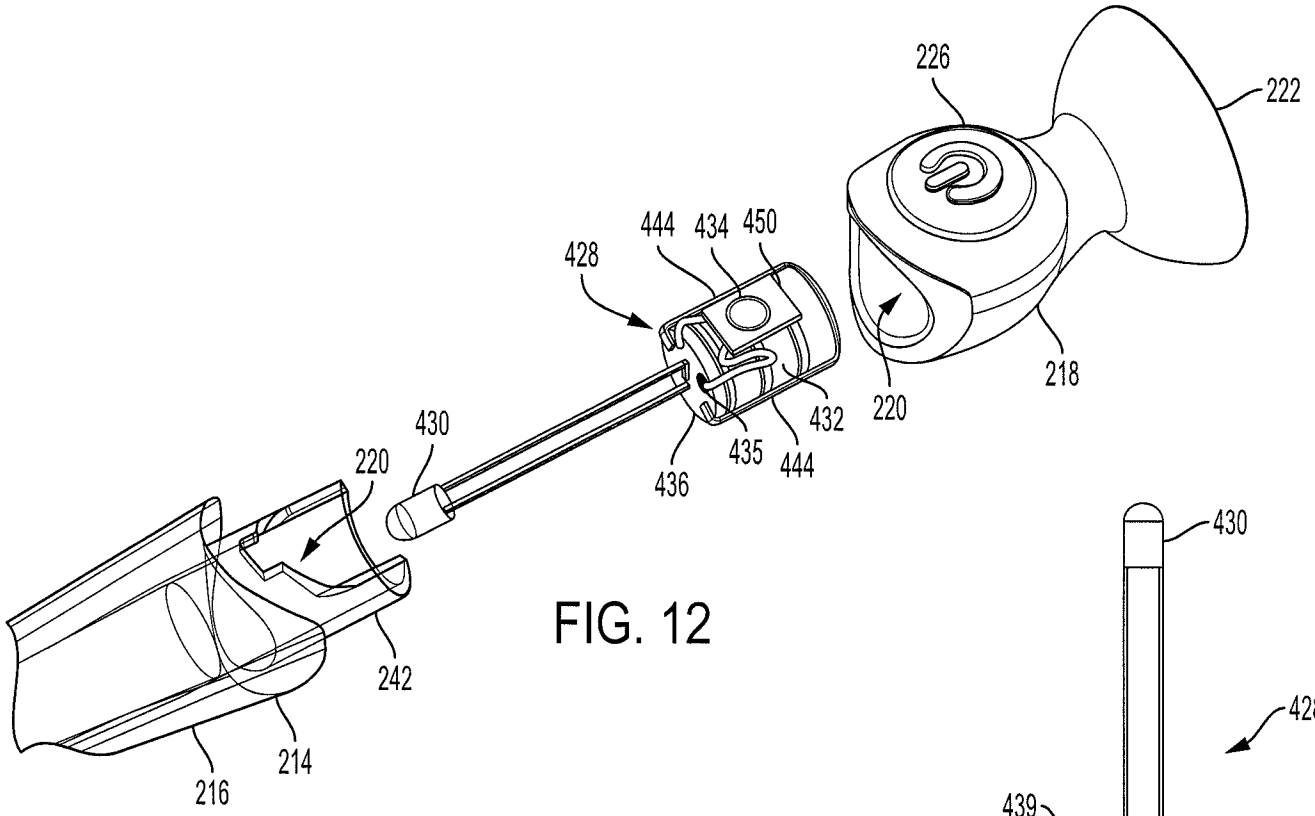
FIG. 12 illustrates a side perspective view of a toothbrush in a disassembled state, according to an embodiment of the present disclosure.

FIG. 12 illustrates a side perspective view of the toothbrush 210 including lighting mechanism 428. Lighting mechanism 428 includes the same structure and operation as lighting mechanism 328, however, the lever activation device 334 of lighting mechanism 328 has been replaced with an activation device 434 in the form of a dome. The description of lighting mechanism 328 applies to lighting mechanism 428 unless stated otherwise. The dome of activation device 434 may be positioned on a substrate 450. The substrate 450 may be a printed circuit board substrate, with the dome electrically coupled to electrical conduits of the substrate 450. The dome may be electrically coupled to the control circuit 435. The control circuit 435 may be positioned on a printed circuit board located on or forming plate 439.

Figure 13:
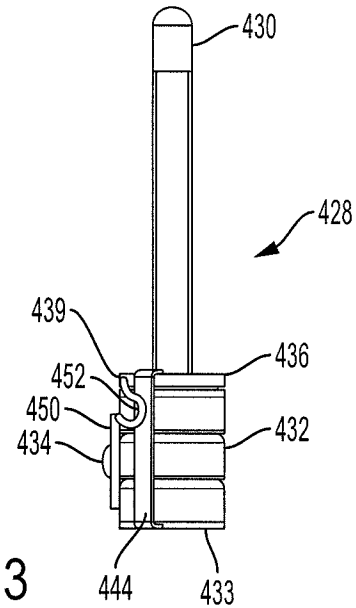
FIG. 13 illustrates a side view of a lighting mechanism, according to an embodiment of the present disclosure.

FIG. 13 illustrates a side view of the lighting mechanism 428. The connecting structure 436 may include connectors 444 that join the plates 433, 439 together, and extend over the sides of the power source 432. Conductive terminals may be positioned on the inner surfaces of the plates 433, 439 to draw power from the power source 432. The plates 433, 439 may sandwich the power source 432.

The substrate 450 extends axially along the length of the lighting mechanism 428. The dome protrudes radially outward from the substrate 450. Wires 452 electrically connect the activation device 434 to the control circuit 435. The wires 452 may have strength sufficient to hold the substrate 450 in position against the side of the power source 432. The wires 452 may suspend the substrate 450 in position without the substrate 450 having additional connection to the remainder of the lighting mechanism 428.

The entire lighting mechanism 428 may form a preassembled unit for insertion into the interior cavity 220. The lighting mechanism 428 may be inserted into the interior cavity 220 through the opening at the bottom of the upper portion 216 of the handle 214. The base 218 may then be molded over the insert portion 242 to form a water tight seal of the interior cavity 220 and secure the lighting mechanism 428 in position within the interior cavity 220. The base 218 may contact and press the bottom of the lighting mechanism 428 to hold the lighting mechanism 428 in position within the interior cavity 220. The position of the lighting mechanism 428 at the power end of the toothbrush may beneficially allow light from the light 430 to fill the upper portion 216 of the handle 214.

Figure 14:
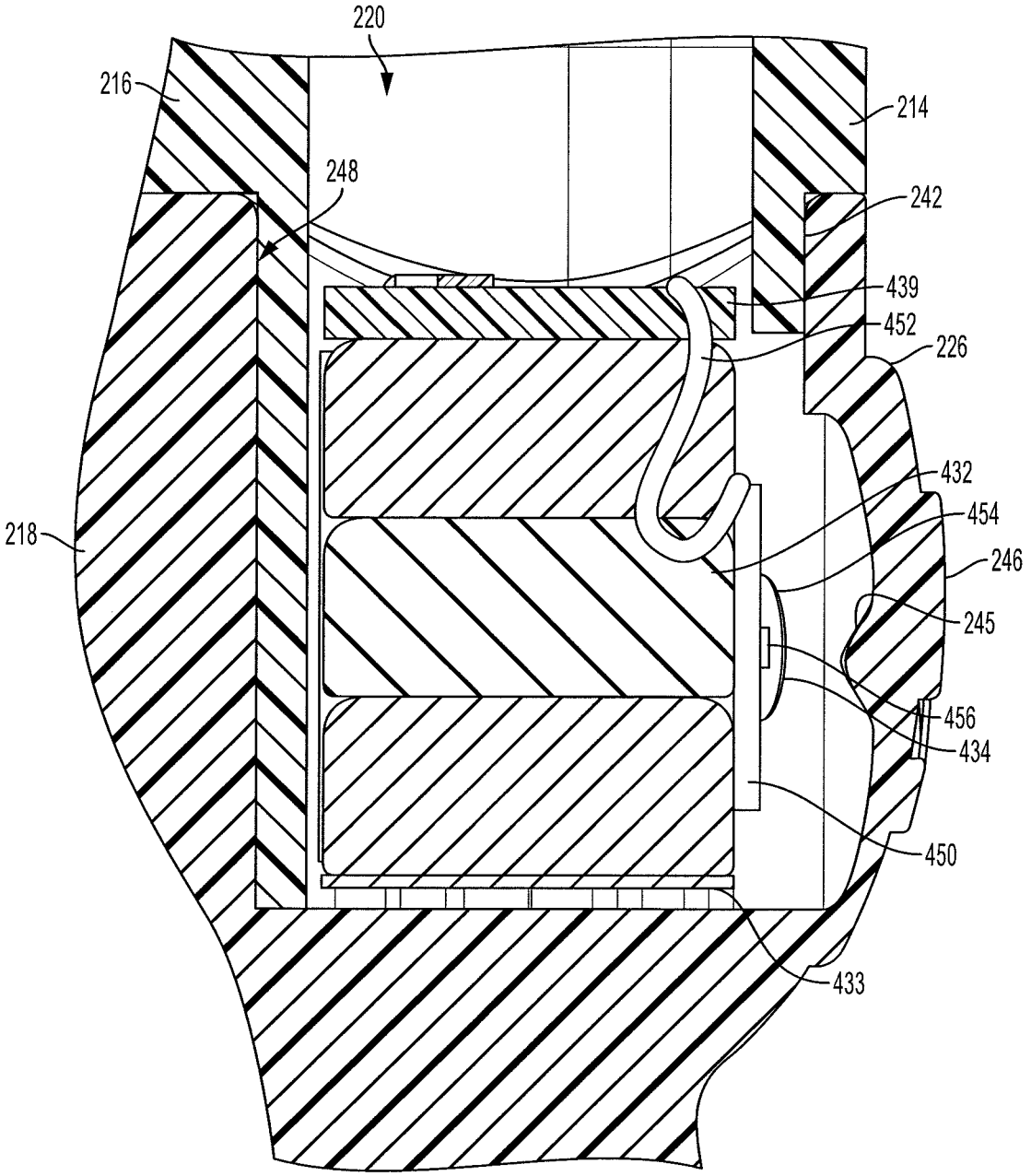
FIG. 14 illustrates a side cross section view of the lighting mechanism shown in FIG. 13 in position within the cavity of the toothbrush shown in FIG. 12.

FIG. 14 illustrates a side cross sectional view of the lighting mechanism 428 in position within the interior cavity 220 of the handle 214. The activation device 434 is positioned to directly contact the interior surface 248 of the base 218. The activation device 434 is positioned such that the protrusion 245 contacts the activation device 434 to activate the light 430.

The push point 226 forms a portion of the base 218 that is raised and is positioned adjacent the bottom of the toothbrush. The push point 226 may have a circular shape sized for a thumb to be placed upon. The push point 226 may be integral with the remainder of the base 218. The suction cup 222 and push point 226 may form a single piece that extends over the insert portion 242. The push point 226 may be beneficially positioned at a low portion of the handle 214 so that the user will not accidently push the push point 226 when the toothbrush is in use. The entire length of the toothbrush is measured from the uppermost end of the head 212 of the toothbrush to the lowermost end of the suction cup 222. With respect to the entire length of the toothbrush, in one embodiment, the push point 226 may be positioned within the lower third of the toothbrush. In one embodiment, the push point 226 may be positioned within the lower fifth of the entire length of the toothbrush. In an embodiment in which the push point 226 is a raised portion of the toothbrush, the upper end of the raised portion in one embodiment may be positioned within the lower fifth of the entire length of the toothbrush. In one embodiment, the middle of the raised portion may be positioned within the lower 15% of the entire length of the toothbrush. In one embodiment, the lower end of the raised portion may be positioned within the lower 10% of the entire length of the toothbrush. In one embodiment, the raised portion may form more than 5% of the entire length of the toothbrush.

The activation device 434 is oriented such that the activation device 434 is not operative unless the push point 226 is pushed in the direction transverse to the longitudinal axis of the toothbrush, or in a single direction. For example, a force applied to the bottom of the toothbrush, or a force applied along the longitudinal axis of the toothbrush will not activate the activation device 434. Such a feature beneficially prevents the activation device 434 from being activated when a user places the bottom of the toothbrush down on a surface, for example, to apply the suction cup to a surface to fix the toothbrush in position. No force against the toothbrush, other than a force against the push point 226 will activate the toothbrush. This feature may beneficially prevent inadvertent use of the toothbrush and a longer life for the power source 432.

The activation device 434 in the form of the dome may include an outer electrical terminal 454 and an inner electrical terminal 456. FIG. 14 illustrates a cut away view of the interior of the dome. The outer electrical terminal 454 may be dome shaped. The inner electrical terminal 456 may be positioned within the dome of the outer electrical terminal 434 and on the substrate 450. The outer electrical terminal 454 may be resilient and configured to be depressed to contact the inner electrical terminal 456. The contact between the outer electrical terminal 454 and inner electrical terminal 456 may complete a circuit. The circuit may be completed through the wires 452, which are electrically connected to the control circuit 435. After the force on the outer electrical terminal 454 is removed, the resilient outer electrical terminal 454 may return to its original shape. The structure of the activation device 434 may beneficially ensure that the activation device 434 is not operative unless the push point 226 is pushed in the direction transverse to the longitudinal axis of the toothbrush, or in a single direction. The structure of activation device 434 and the remainder of toothbrush 210 beneficially provide improved usage and reliability of the toothbrush 210.

Figure 15:
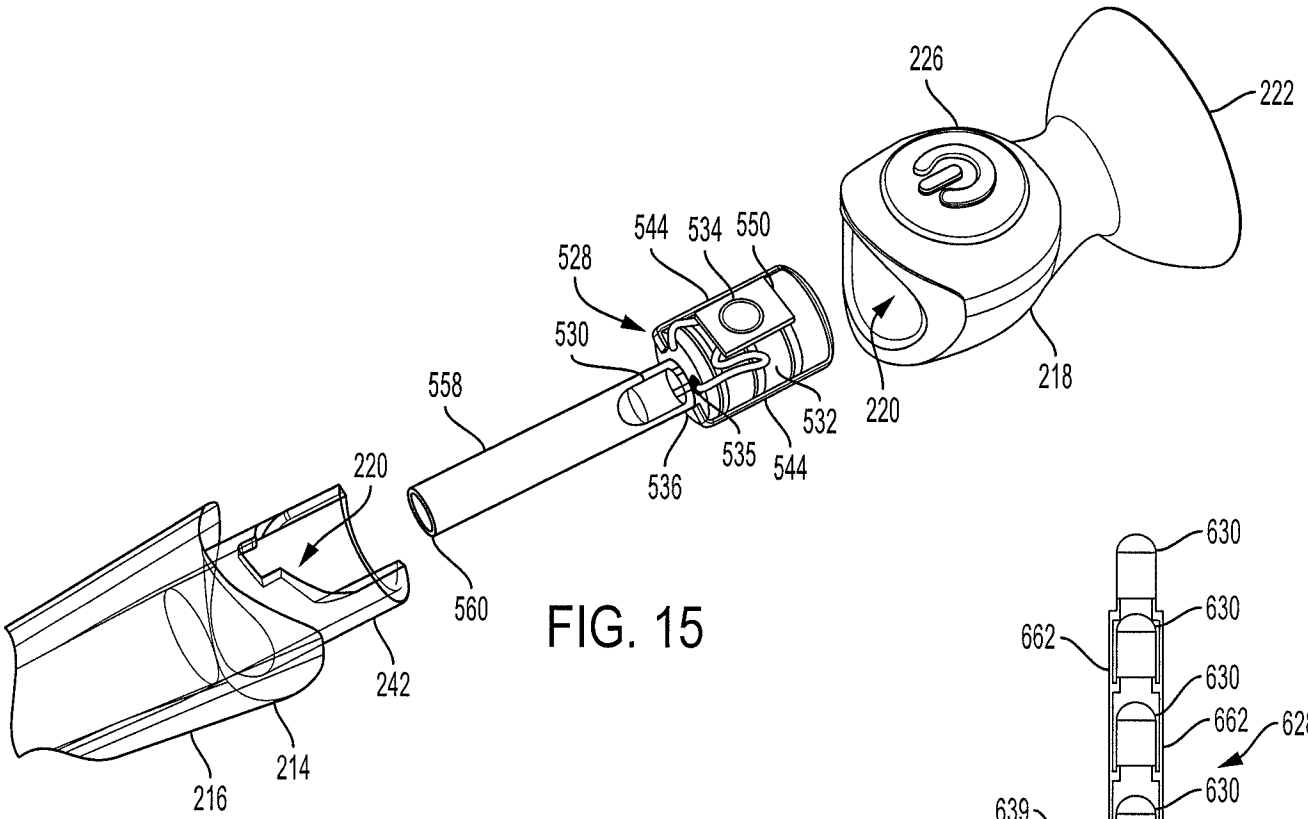
FIG. 15 illustrates a side perspective view of a toothbrush is a disassembled state, according to an embodiment of the present disclosure.

FIG. 15 illustrates a side perspective view of the toothbrush 210 including lighting mechanism 528. Lighting mechanism 528 includes the same structure and operation as lighting mechanism 428, however, a tube 558 has been incorporated in the lighting mechanism 528. The description of lighting mechanism 428 applies to lighting mechanism 528 unless stated otherwise. The lighting mechanism 528 may include a power source 532, an activation device 534, a control circuit 535, a connecting structure 536, connectors 544, and a substrate 550.

The tube 558 may be configured to extend around the light 530 and may be configured to allow light from the light 530 to pass through the tube 558. The light from the light 530 may pass through the outer surface of the tube 558. The wall of the tube 558 may be transmissive to light. The tube 558 may have a cylindrical shape. The light 530 may be positioned within a central interior cavity of the tube 558.

In one embodiment, the tube 558 may be configured as a light diffuser and may diffuse the light produced by the light 530. The tube 558 may be made of light diffusive material. The tube 558 may allow the light from the light 530 to appear as a beam of light that extends along the tube 558. The diffused light may pass through the outer surface of the tube 558 along the entire length of the tube 558 and then pass through the outer surface of the handle 214. The diffused light may have the appearance of a laser beam or laser sword or the like. In an embodiment in which the light 530 remains on for a period of time after activation of the activation device 534, the diffused light may have the appearance of a solid beam of light indicating a duration for the user to use the toothbrush.

An end 560 of the tube 558 may be open. In one embodiment, the end 560 of the tube 558 may be closed and may include diffusive material. In one embodiment, the end 560 of the tube 558 may be closed and include reflective material to reflect light from the light 530 back down the tube 558 for passage through the outer surface of the tube 558.

The length of the tube 558 may extend along the length of the interior cavity 220. The tube 558 may extend along the entirety of the upper portion 216 of the handle 214, or any portion thereof.

The light 530 may be positioned at a lower end of the tube 558, to allow light from the light 530 to extend along the length of the tube 558.

In one embodiment, the tube 558 may be replaced by a solid light diffuser, without an interior cavity. The solid light diffuser may have a cylindrical shape. Light from the light 530 may pass through the solid light diffuser and may be passed through the outer surface of the light diffuser and the handle 214.

In one embodiment, the tube 558 may be configured to reflect light from the light 530 down the length of the tube 558 with a majority of the light from the light 530 passing through the end 560. In this manner, the tube 558 may serve as a form of fiber optic wire, directing light to pass through the end 560 of the tube 558. In one embodiment, the tube may be replaced with a solid structure that operates in a similar manner to direct through the end 560 of the tube 558.

Figure 16:
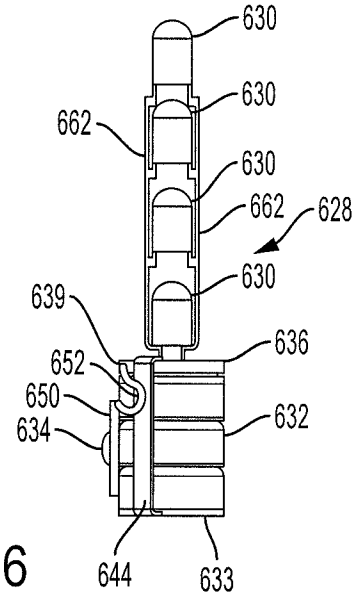
FIG. 16 illustrates a side view of a lighting mechanism, according to an embodiment of the present disclosure.

FIG. 16 illustrates a side view of a lighting mechanism 628. Lighting mechanism 628 includes the same structure and operation as lighting mechanism 428, however, a plurality of lights 630 are utilized. The description of lighting mechanism 428 applies to lighting mechanism 628 unless stated otherwise. The lighting mechanism 628 may include a power source 632, an activation device 634, a connecting structure 636, plates 633, 639, connectors 644, a substrate 650, and wires 652.

The plurality of lights 630 may form a columnar shape extending from the remainder of the lighting mechanism 628, including the upper plate 639. The lights 630 may be positioned in line with each other, and may be positioned on the same axis. The lights 630 may be stacked one upon another in sequence. Electrical connectors 662 may connect the plurality of lights 630 to the power source 632. The lights 630 may be inserted into the cavity 220 of the handle 214 when the lighting mechanism 628 is inserted into the handle 214. The lights 630 may extend along the length of the handle 214. The columnar shape formed by the lights may form an appearance of a beam of light positioned in the handle 214. In an embodiment in which the light 630 remains on for a period of time after activation of the activation device 634, the series of lights may have the appearance of a solid beam of light indicating a duration for the user to use the toothbrush. In one embodiment, the tube 558 or a solid structure described in regard to FIG. 15 may be incorporated with the lights 630 to produce an effect described in regard to FIG. 15.

The lighting mechanisms 128, 228, 328, 428, 528, 628 may be interchanged among the toothbrushes 110, 210 as desired. For instance, the lighting mechanisms 228, 328, 428, 528, 628 may be utilized in the handle 114 shown in FIG. 1, and the lighting mechanism 128 may be utilized in the handle 214, as desired. In one embodiment, a motor may be included with any of the toothbrush to provide movement of the bristles. The motor may be activated by any of the activation devices.

The construction of the embodiments of toothbrushes disclosed herein may beneficially enhance durability of the toothbrushes, and reduce expenses associated with manufacture of the toothbrushes. The construction of the embodiments of toothbrushes may also allow a child to more easily activate the toothbrush.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only, and is not intended to limit the scope of systems, apparatuses, and methods as disclosed herein, which is defined solely by the claims. Accordingly, the systems, apparatuses, and methods are not limited to that precisely as shown and described.

Certain embodiments of systems, apparatuses, and methods are described herein, including the best mode known to the inventors for carrying out the same. Of course, variations on these described embodiments will become apparent to those of ordinary skill in the art upon reading the foregoing description. The inventor expects skilled artisans to employ such variations as appropriate, and the inventors intend for the systems, apparatuses, and methods to be practiced otherwise than specifically described herein. Accordingly, the systems, apparatuses, and methods include all modifications and equivalents of the subject matter recited in the claims appended hereto as permitted by applicable law. Moreover, any combination of the above-described embodiments in all possible variations thereof is encompassed by the systems, apparatuses, and methods unless otherwise indicated herein or otherwise clearly contradicted by context.

Groupings of alternative embodiments, elements, or steps of the systems, apparatuses, and methods are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses an approximation that may vary. The terms "approximate[ly]" and "substantial[ly]" represent an amount that may vary from the stated amount, yet is capable of performing the desired operation or process discussed herein.

The terms "a," "an," "the" and similar referents used in the context of describing the systems, apparatuses, and methods (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the systems, apparatuses, and methods and does not pose a limitation on the scope of the systems, apparatuses, and methods otherwise claimed. No language in the present specification should be construed as indicating any non-claimed element essential to the practice of the systems, apparatuses, and methods.

All patents, patent publications, and other publications referenced and identified in the present specification are individually and expressly incorporated herein by reference in their entirety for the purpose of describing and disclosing, for example, the compositions and methodologies described in such publications that might be used in connection with the systems, apparatuses, and methods. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

What is claimed is:

1. A toothbrush comprising:

a head including a plurality of bristles;

a handle connected to the head, extending in a longitudinal direction;

a base being made of a flexible material overlapping the handle, and having a sidewall with a raised push point for a user to press;

a light configured to emit light visible from outside the handle;

a power source positioned in the toothbrush and configured to supply power to the light; and an activation device positioned in the toothbrush and configured to be pressed in a direction transverse to the longitudinal direction to activate the light upon the user pressing on the push point of the sidewall of the base.

2. A toothbrush as set forth in claim 1 wherein the activation device comprises a switch positioned in an interior cavity to complete a circuit to cause the light to be activated upon a user pressing on the push point of the sidewall of the base.

3. A toothbrush as set forth in claim 2 wherein the switch is a dome switch.

4. A toothbrush as set forth in claim 2 wherein the switch comprises a first electrical terminal and a second electrical terminal and is configured such that the first electrical terminal contacts the second electrical terminal to complete the circuit when the activation device is pressed.

5. A toothbrush as set forth in claim 1 wherein an interior surface of the base positioned opposite the push point is configured to contact the activation device to press the activation device to activate the light.

6. A toothbrush as set forth in claim 5 wherein the interior surface of the base positioned opposite the push point includes a protrusion configured to contact the activation device.

7. A toothbrush as set forth in claim 1 wherein the light, the power source, and the activation device are coupled to each other to allow the light, the power source, and the activation device to be inserted into an interior cavity of the handle as a unit.

8. A toothbrush as set forth in claim 1 wherein the activation device is configured to be pressed in a direction towards the power source to activate the light upon the user pressing on the sidewall of the base.

9. A toothbrush comprising:

a head including a plurality of bristles;

a handle coupled to the head and extending in a longitudinal direction and including an interior cavity;

a base coupled to the handle and having an interior surface, at least a portion of the base being flexible and defining a push point;

a light positioned in the interior cavity and configured to emit light visible from outside the handle; and a dome switch positioned in the interior cavity to complete a circuit to cause the light to be activated upon a user pressing the push point in a direction transverse to the longitudinal direction.

10. The toothbrush of claim 9 wherein the push point is a raised portion of the base.

11. The toothbrush of claim 9 further comprising a power source positioned in the interior cavity such that the dome switch is positioned between the power source and the push point.

12. The toothbrush of claim 9 wherein the dome switch comprises a first electrical terminal and a second electrical terminal and is configured such that the first electrical terminal contacts the second electrical terminal to complete the circuit when the dome is pressed.

13. The toothbrush of claim 9 further comprising a suction cup positioned at a bottom of the base.

14. The toothbrush of claim 9 wherein a sidewall of the base is substantially parallel to the longitudinal direction.

15. The toothbrush of claim 9 wherein the push point is capable of being pressed by a human finger.

* * * * *